US005273123A

United States Patent [19]

Bardin et al.

[11] Patent Number: 5,273,123

[45] Date of Patent: Dec. 28, 1993

[54] FITTING FOR CONTROLLED TRAJECTORY DRILLING, COMPRISING A VARIABLE ANGLE ELBOW ELEMENT AND USE OF THIS FITTING

[75] Inventors: Christian Bardin, Rueil Malmaison; Jean Boulet, Paris; Pierre Morin, Levallois Perret, all of France

[73] Assignee: Institut Francais Du Petrole, Rueil - Malmaison Cedex, France

[21] Appl. No.: 459,285

[22] Filed: Dec. 29, 1989

[30] Foreign Application Priority Data

Dec. 30, 1988 [FR] France ..... 88 17598

[51] Int. Cl.[5] ..... E21B 7/08

[52] U.S. Cl. ..... 175/74; 175/256

[58] Field of Search ..... 175/61, 73, 74, 75, 175/76, 325, 256

[56] References Cited

U.S. PATENT DOCUMENTS

| | | | |
|---|---|---|---|
| 4,077,657 | 3/1978 | Trzeciak | 285/184 |
| 4,739,842 | 4/1988 | Kruger et al. | 175/61 |
| 4,817,740 | 4/1989 | Beimgraben | 175/74 |
| 4,836,303 | 6/1989 | Boulet et al. | 175/74 |
| 4,877,092 | 10/1989 | Helm et al. | 175/74 |

*Primary Examiner*—William P. Neuder

*Attorney, Agent, or Firm*—Antonelli, Terry Stout & Kraus

[57] ABSTRACT

A fitting for controlled trajectory drilling. This fitting comprises a downhole motor, a drilling tool, at least one stabilizer and a remote controlled variable angle elbow element.

18 Claims, 9 Drawing Sheets

FITTING FOR CONTROLLED TRAJECTORY DRILLING, COMPRISING A VARIABLE ANGLE ELBOW ELEMENT AND USE OF THIS FITTING

BACKGROUND OF THE INVENTION

The present invention relates to controlled trajectory drilling fitting adapted to be placed at the end of a drill-string so as to enable a control, in a real time, of variations of direction and of inclination of the drill hole and to enable an accurate control of the azimuth and radius of curvature as well as to reduce a friction phenomena and limit risks of jamming without requiring the fitting to be raised to the surface.

The fitting of the present invention comprises a drill tool placed at its lower end, a motor for rotating the tool and at least one stabilizer and a variable geometry elbow element, i.e. whose angle is variable.

The fitting of the present invention may comprise another stabilizer.

The stabilizer may have fixed or variable geometry. The elbow element and/or the stabilizer may be integrated with the motor.

The variable geometry stabilizer may comprise means adapted for varying the distance between the axis of the fitting and the bearing surface of at least one blade of the stabilizer and/or means adapted for varying at least axially the position of the bearing surface of at least one blade of said stabilizer.

The fitting of the present invention may comprise at least one stabilizer which is interlocked for rotation with the tool.

The fitting of the present invention may comprise at least one stabilizer fast for rotation with the body of the motor.

If required the variable geometry elbow element may be remote controlled from the surface.

The fitting of the present invention may in addition to the variable geometry elbow element comprise a stabilizer possibly with variable geometry, as well as two other stabilizers placed on each side of the stabilizer. The elbow element may be integrated with the motor.

The present invention relates to the use of one of the above described fittings at the end of a drill-string which may be driven in rotation by drive means situated on the surface.

Of course, the fitting of the present invention may provide control of the azimuth (of the direction of the drill hole), which may be facilitated by an elbow element integrated in the downhole motor, with no rotation being applied to the drill-string from the surface.

Control of the radius of curvature is facilitated by the association of an elbow element and a stabilizer.

By an elbow element is meant a member introducing or able to introduce locally, if not at a point, a discontinuity in the direction of the axis of the drillstring. That is to say that the axis of the drilling fitting is a crooked line at the level of the elbow element.

BRIEF DESCRIPTION OF THE DRAWINGS

The present invention will be better understood and its advantages will be clear from the following description of particular examples illustrated by the accompanying figures, in which.

DESCRIPTION OF THE PREFERRED EMBODIMENTS

Figure 1:
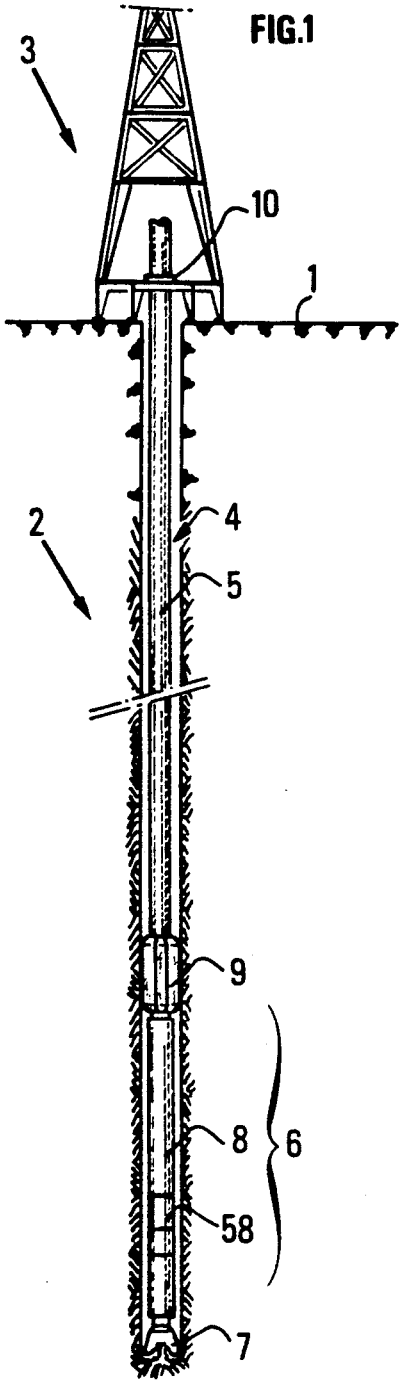
FIG. 1 shows one embodiment of a fitting according to the present invention.

Referring now to the drawing wherein like reference numerals are used throughout the various views to designate like parts and, more particularly, to FIG. 1, according to this figure, a drilling surface installation generally designated by the reference numeral 3 includes drilling equipment generally designated by the reference numeral 4 having a drill-string 5 to the end of which is fixed a drilling fitting 6, with the drilling equipment 4 being arranged in a well 2 extending from a ground surface 1.

A drilling fitting generally has a length of a few tens of meters, with the thirty meters or so the nearest to the drilling tool generally being considered as active in so far as the control of the trajectory is concerned.

In the FIG. 1, the drilling fitting 6 comprises a drilling tool 7, a downhole motor 8, a variable angle elbow element 58 and a stabilizer 9, drilling tool may be rotated by the downhole motor 8 or by the drill-string 5 which may be driven from the surface 1 by drive means 10 such as, for example, a turntable.

The stabilizer 9 may be with fixed geometry or variable geometry, by that is meant, in accordance with the present invention, that it may be adjusted for varying the geometrical configuration of the bearing points of the blades on the walls of the drilled well, this variation being considered for the same position of the fitting in the drilled well.

Figure 2:
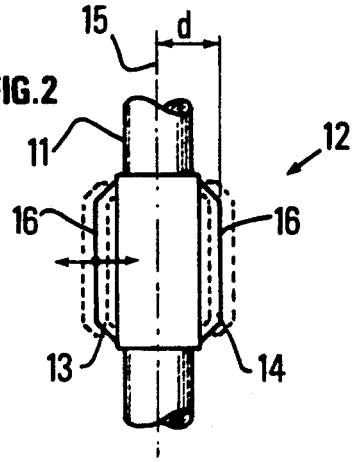
FIGS. 2 to 4 show different types of variable
Figure 3:
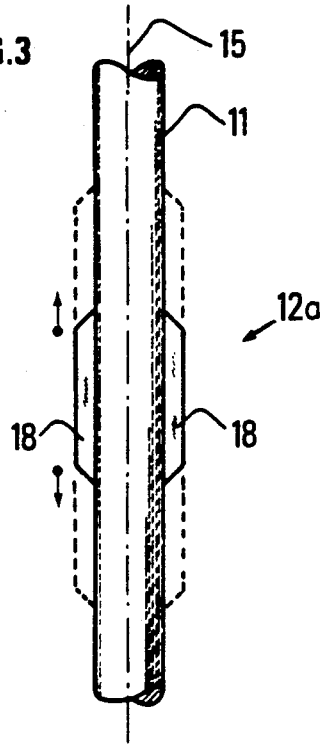
Figure 4:
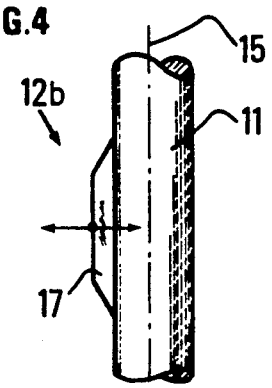

FIGS. 2–4 provide illustrative examples of different types of variable geometry stabilizers generally designated by the reference numerals 12, 12*a*, 12*b* arranged on a drill-string 11, with the stablizer 12 including, for example, two blades 13, 14.

In the embodiment of FIG. 2, the blades 13, 14 may move in the direction of the double headed arrows so as to vary the distance d which separates axis 15 of the drill-string portion 11 from the friction surface 16 of blade 14 or 13, whereby the blades 13, 14 may assume the positions illustrated in broken lines.

FIG. 3 shows a variable geometry stabilizer 12*a* in which the blades 18 move axially, as shown by the arrows. The broken lines show possible positions of the blades 18. in FIG. 4 the stablizer 12*b* is provided with a single movable blade 17. The stabilizer 12*b* is often termed "offset". Of course, the same offset effect of axis 15 is obtained by having several movable blades placed on the same side of an axial plane containing axis 15, or by causing the blades situated on the same side of an axial plane containing axis 15 to move more extensively than the blades situated on the other side of the same plane.

Without departing from the scope of the present invention, variable geometry stabilizers may be used of other types than those described above, particularly using blades which combine the different above mentioned movements.

Figure 5:
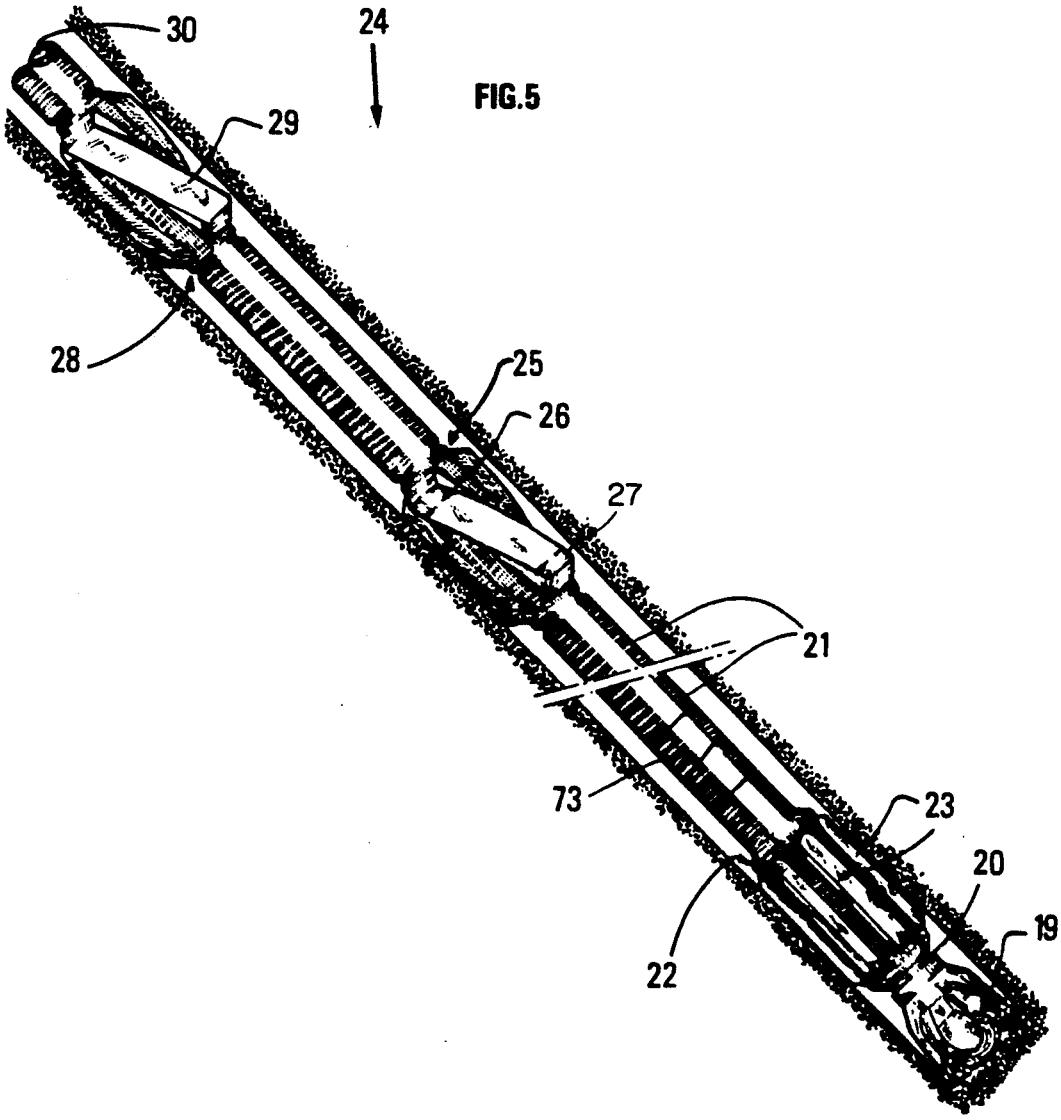
FIG. 5 illustrates a fitting having three fixed geometry stabilizers and a variable angle elbow element.

It is also possible as shown in FIG. 5 for the blades to have a helical shape particularly for a central stabilizer. In FIG. 5, a drilling tool 19 is fixed to a shaft 20 driven by a motor 21. A fixed geometry stabilizer generally designated by the reference numeral 22 is disposed in parallel to the axis of a drill fitting generally designated by the reference numeral 24, with the fixed geometry stabilizer 22 comprising rectilinear blades 23. A variable angle elbow element 73 is interposed between the fixed geometry stabilizer 22 and a further fixed geometry stabilizer generally designated by the reference numeral 25, with the fixed geometry stabilizer 25 including blades 26 with friction or cutting surfaces 27. Yet another fixed geometry stabilizer generally designated by the reference numeral 28 is disposed upstream of the fixed geometry stabilizer 25, with the fixed geometry stabilizer 28 including a helical blade 29.

Motor 21 may be a lobe motor of the "Moineau" type or a turbine fed with drilling fluid from a passage 30 formed in the fitting, with the passage 30 being itself fed with drilling fluid from the hollow drill-string. After passing through the motor 21, the drilling fluid is directed towards tool 19 for removing the cuttings. As can readily be appreciated, the motor 21 may also be an electric motor fed, for example, from the surface 1 by way of a cable (not shown).

Figure 6:
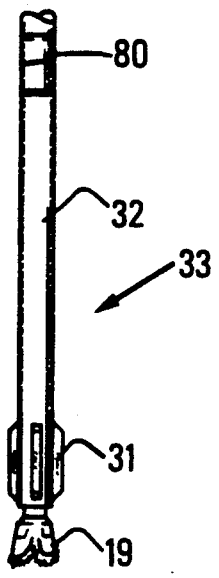
FIGS. 6 and 7 show variants of a stabilizer and of the elbow element.
Figure 7:
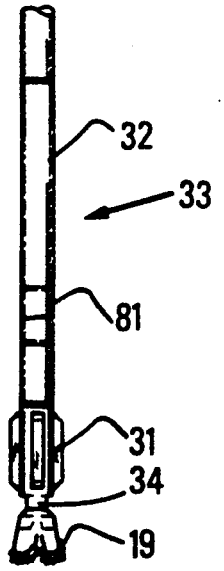

Concerning a lower stabilier 31, namely the one which is the closest to tool 19, the stabilizer may be placed either on the external body 32 of a motor generally designated by the reference numeral 33, as is the case of FIG. 6, or on the shaft 34 rotating tool 19. This is the case of FIG. 7. In these two figures, the stabilizer The variable angle elbow element may be fixed above the motor, this is the case of the elbow element 80 shown in FIG. 6 or integrated in the motor 33, which is the case of the elbow element 81 shown in FIG. 7.

Figure 8:
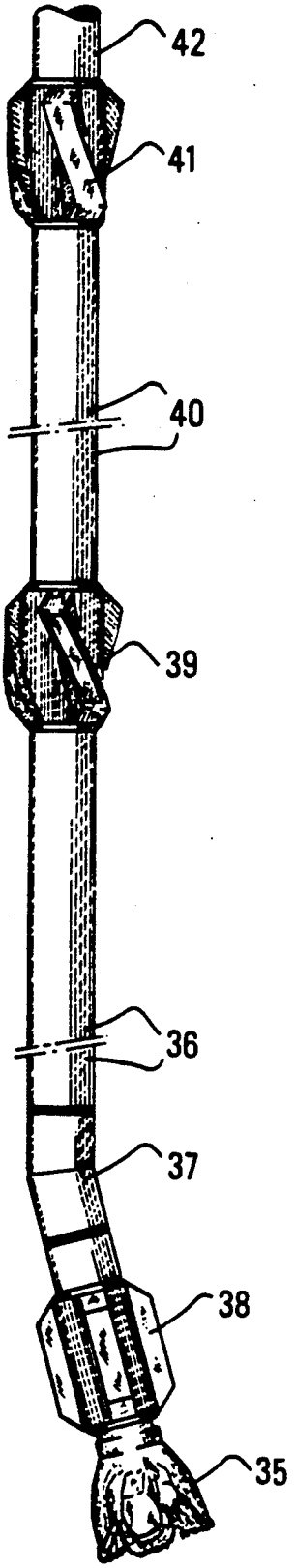
FIG. 8 illustrates a particular embodiment comprising three stabilizers, one of which has variable geometry and a variable angle elbow element.

The fitting of FIG. 8 performs particularly well and comprises, in so far as the lower part is concerned, that is, approximately the first 30 meters, a drilling tool 35, a downhole motor 36, for example, a volumetric motor, having a body forming an elbow element or variable angle element 37 in a lower half thereof and equipped with a stabilizer 39 positioned on the elbowed portion 36, with the elbow 37 having an angle preferably less than 3 degrees. The fitting also includes a variable diameter stabilizer 39 which may be remotely controlled from the surface, a drill collar 40 comprising means for measuring, during drilling (MwD), the main directional parameters such as, for example, inclination, azimuth, tool face, and transmitting the parameters to the surface, as well as constant diameter stabilizer 41 and drill collars 42 along with possibly one or more other stabilizers, heavy rods and a bumper sub, with the entire assembly being connected to the surface by a drill-string. The drilling tool 35 may, for example, be a cone bit with a cutting element made from polycrystalline diamond or other synthetic material and which is capable of withstanding a rotational speed coherent with the use of a downhole motor. Thus, the drilling tool 35 is selected so as to have a long useful life.

Figure 9A:
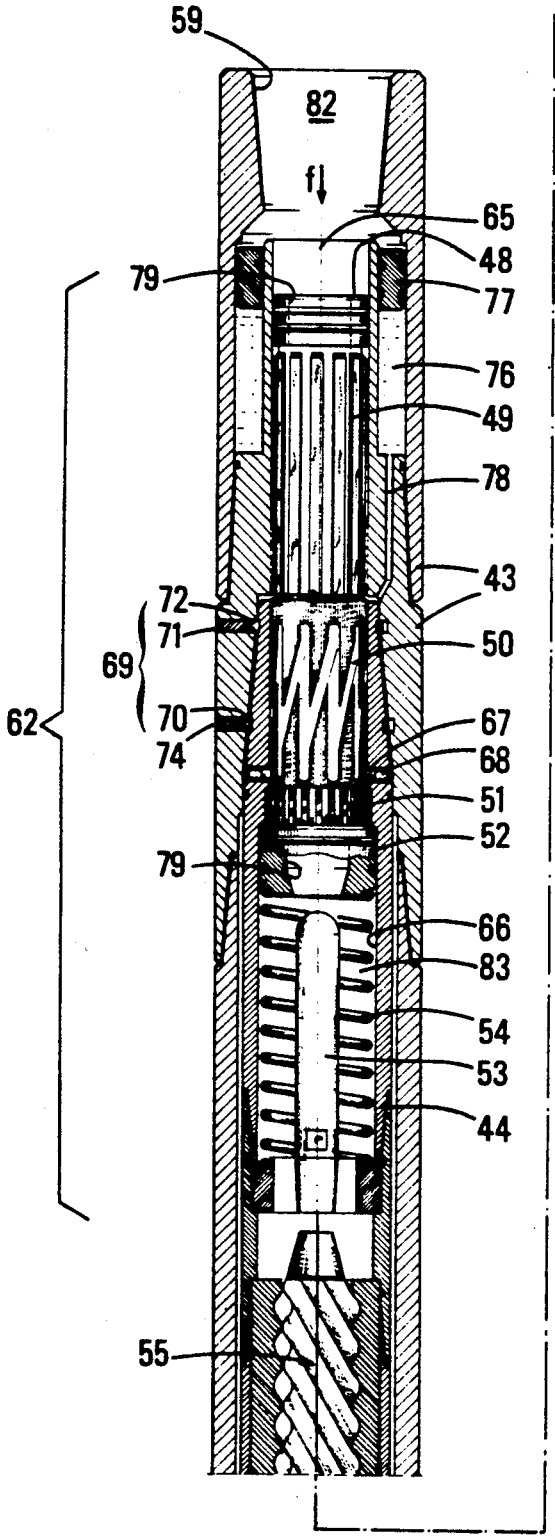
FIGS. 9A and 9B show one embodiment of the present invention in which the angle of an elbow situated at the level of the universal joint of a downhole motor may be varied.
Figure 9B:
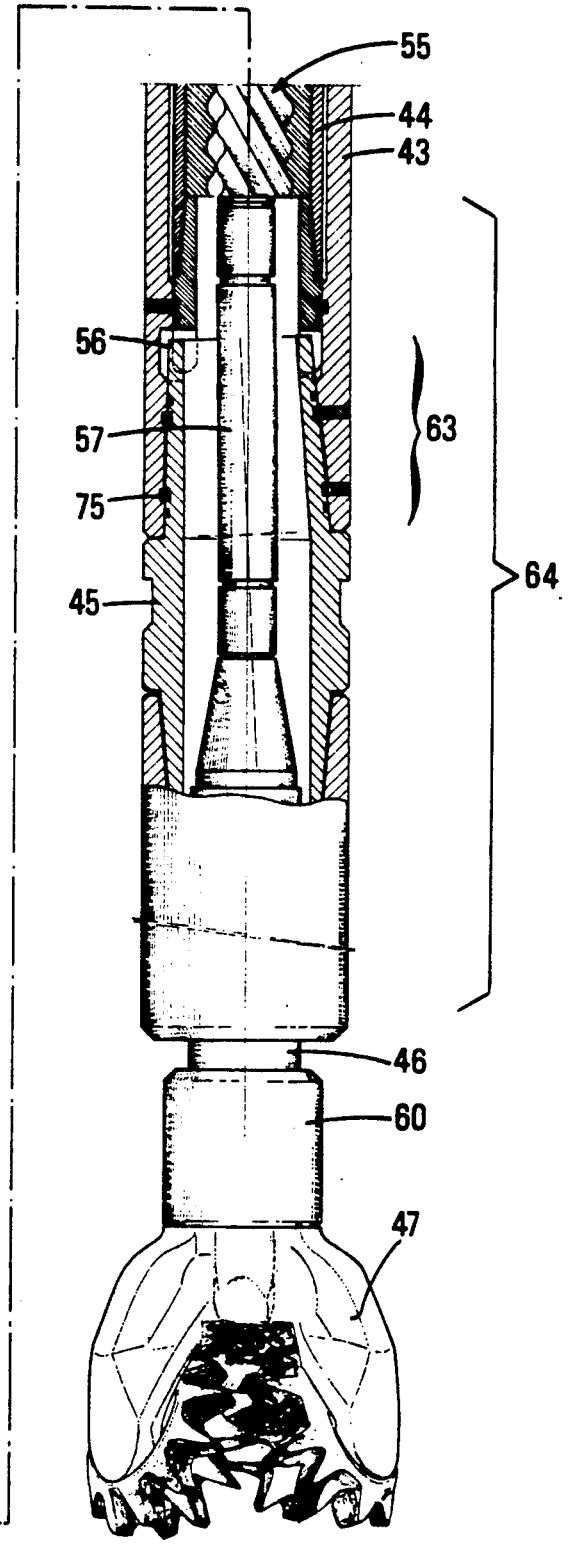
Figure 10:
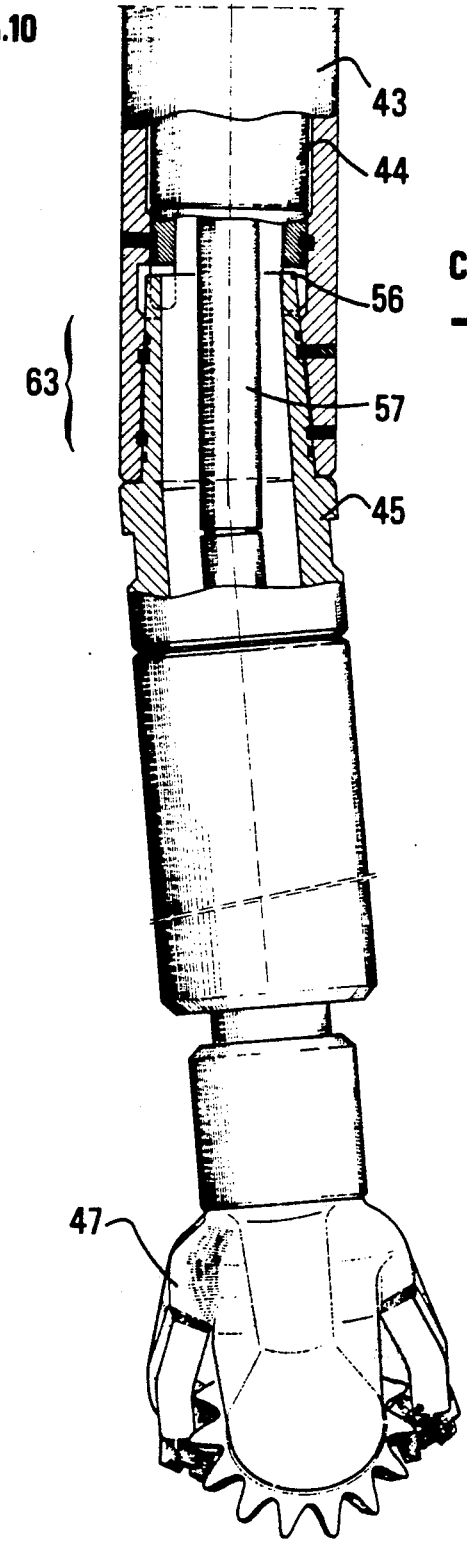
FIG. 10 shows the device of FIG. 9B in a different configuration.

FIGS. 9A, 9B and 10 show a particularly advantageous embodiment of a variable angle elbow element. In this embodiment, a tubular shaped element has at an upper portion thereof a threaded part 59 for mechanical connection to the drilling fitting and at a lower portion thereof a threaded portion 60 on the output shaft 46, adapted to be threaded on the drilling tool 47.

As shown in FIGS. 9A, 9B and 10, a downhole motor 55 such as, for example, a multilobe volumetric motor of a Moineau type, is provided with a remote control mechanism sensing a change of position information and causing differential rotation of a tubular body 44 relative to a tubular body 43. A drive mechanism 64 absorbs axial and lateral forces and connected the downhole motor 55 to the output shaft 46 in a conventional manner, with a mechanism 63 being provided for varying the geometry based on the rotation of the tubular body 44. A universal joint 57 is provided and is useful when the motor is of a Moineau type and/or when an elbow element 63 is used. The downhole motor 55 may also be of any other type of downhole motor such as, for example, a volumetric or turbine type, currently used for land drilling.

The remote control mechanism is formed of a shaft 48, which may slide by its upper part in bore 65 of body 43 and by its lower part in bore 66 of body 44. This shaft comprises male spline portions 49 engaging in female spline portions of body 43, grooves 50 which are alternately straight (parallel to the axis of the tubular body) and oblique (slanted with respect to the axis of the tubular body 43) in which are engaged fingers 67 sliding along an axis perpendicular to the axis of movement of shaft 48 and held in contact with the shaft by springs 68, and male spline portions 51 meshing with female spline portions of body 44 only when the shaft 48 is in the top position.

Shaft 48 is equipped in its low part with a bean 52 facing which is disposed a needle 53 which is coaxial to the movement of shaft 48. A return spring 54 holds the shaft in the top position, spline portions 51 meshing with the equivalent female spline portions of body 44.

Bodies 43 and 44 are free to rotate at the level of the rotating bearing surface 69 coaxial with the axes of bodies 43 and 44 and formed of rows of cylindrical rollers 70 inserted in their running tracks 72 and which can be removed through orifices 74 by removing door 71.

An oil reserve 76 is held at the pressure of the drilling fluid via a free annular piston 77. The oil lubricates the sliding surfaces of shaft 48 via passage 78. The shaft 48 is machined so an axial bore allows the drilling fluid to flow in the direction of the arrow f (FIG. 9A).

Figure 13:
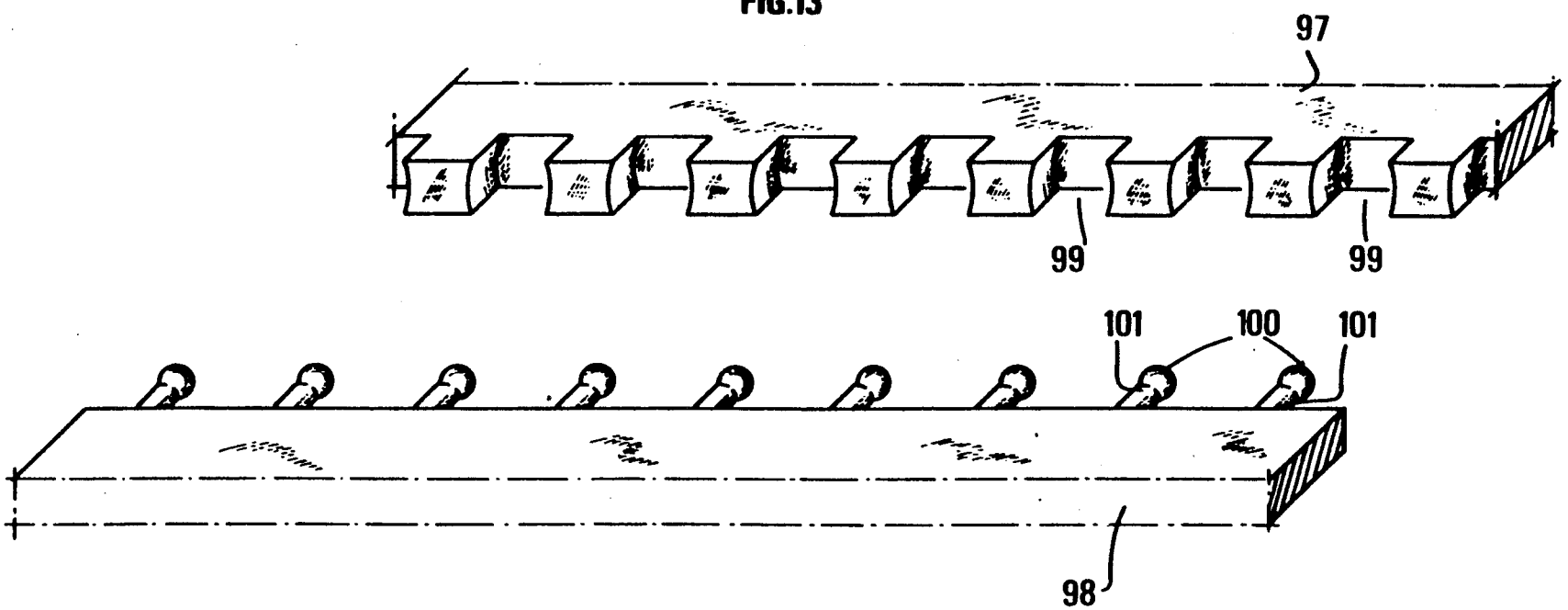
FIG. 13 illustrates a detail in a developed form of the torque transmission member between two tubular elements while permitting flexion between these two elements.

The angle varying mechanism properly speaking comprises a tubular body 45 which is locked for rotation with tubular body 44 by a coupling 56 of the type more clearly shown, for example, in FIG. 13. The tubular body 45 may rotate with respect to the tubular body 43 at the level of the rotating bearing surface 63 comprising rollers 75 and having an oblique axis with respect to the axes of the tubular bodies 43 and 45.

The operation of the remote control mechanism is described hereafter. This type of remote control is based on a threshold value of the flowrate passing through the mechanism in the direction of the arrow f (FIG. 9A).

When a flowrate Q passes through shaft 48, there occurs a pressure difference P between the upstream portion 82 and the downstream portion 83 of shaft 6. This pressure difference increases when the flowrate Q increases following a law of variation of the type $\Delta P = kQ^n$, k being a constant and n between 1.5 and 2 depending on the characteristics of the drilling fluid. This pressure difference $\Delta P$ is applied on the section S of shaft 48 and creates a force F tending to move shaft 48 by translation downwards and compressing the return spring 54. For a threshold value of the flowrate this force F will become sufficiently high to overcome the return force of the spring and cause a slight translational movement of the shaft.

Because of this translational movement the bean 52 will surround needle 53, which will greatly reduce the flow section of the drilling fluid and so greatly increase the pressure difference $\Delta P$ and so cause a great increase of force F' causing complete downward movement of this shaft 48, despite the increase in the return force of spring 54 due to its compression.

Because of the machined shape of grooves 50 described in the patent FR-2 432 079, fingers 67 will follow the oblique portion of groove 50 during the downward stroke of shaft 48 and will therefore cause rotation of tubular body 44 with respect to tubular body 43, which is made possible by the fact that the male spline portions 51 will be disengaged from the corresponding female spline portions of body 44 at the beginning of the downward stroke of shaft 48.

With the shaft in the low abutment position, the fact of cutting off the flow will make it possible for the return spring 54 to push shaft 48 upwards. During this upward travel fingers 67 will follow the rectilinear portions of grooves 50. At the end of travel, the spline portions 51 will again be engaged so as to interlock the tubular bodies 43 and 44 for rotation.

FIG. 13 shows in a developed way the parts 97 and 98 which transmit the rotation of the tubular body 44 to tubular body 45 while permitting a relative angular movement of these two tubular bodies.

Part 97 comprises housings 99 in which cooperate rods 100 comprising spheres 101. Thus, although the tubular body integral with part 97 bends relatively to the tubular body integral with part 98, one tubular body drives the other in rotation. Thus, these two parts play the same role as a hollow universal drive.

Variation of the angle is obtained by rotating the tubular body 44 relatively to tubular body 43, which causes, via the drive mechanism 56, rotation of the tubular body 45 with respect to the same tubular body 43. Since this rotation occurs about an axis which is oblique with respect to the two axes of the tubular bodies 43 and 45, it will cause a modification of the angle formed by the axes of bodies 43 and 45. This angle variation is shown in detail in the patent FR-2 432 079. FIG. 10 shows the same part of the device as that shown in figure 98, but in a geometrically different position.

An embodiment will now be described of a variable geometry stabilizer. The remote control mechanism for this stabilizer is the same as that described above.

Figure 11:
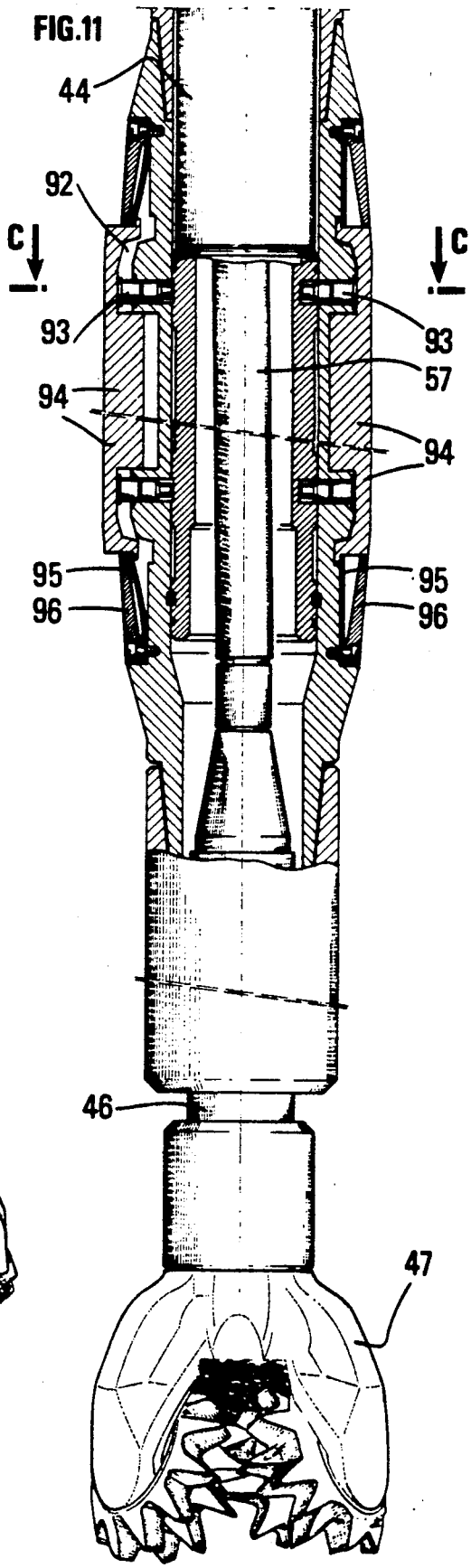
FIG. 11 shows the lower part of a second embodiment of the present invention replacing FIG. 9B, in which the position of one or more blades of a stabilizer may be varied with respect to the main axis of the outer tubular body; this Figure comprises two half sections re two different positions of the blades stabilizer.

FIG. 11 shows the mechanism for varying the position of one or more blades of an integrated stabilizer. FIG. 11 may be considered as being the lower part of FIG. 9A.

At the lower end of body 44 are formed grooves 92 whose depth differs as a function of the angular sector concerned. At the bottom of these grooves are applied pushers 93 on which straight or helical blades 94 bear under the effect of blade return springs 95 positioned under protecting covers 96.

The operation of the mechanism varying the position of one or more blades is described below.

When the tubular body 44 rotates with respect to the tubular body 43, caused by the movement of shaft 48, pushers 93 will be situated on a sector of groove 92 whose depth will be different. That will cause a translational movement of the blades, either away from or towards the axis of the body.

FIG. 11 shows on the right hand side a blade in the "retracted" position and on the left a blade in the "extended" position. Several intermediate positions may be envisaged, depending on the angular rotational pitch of the remote controlled rotation mechanism.

Figure 12:
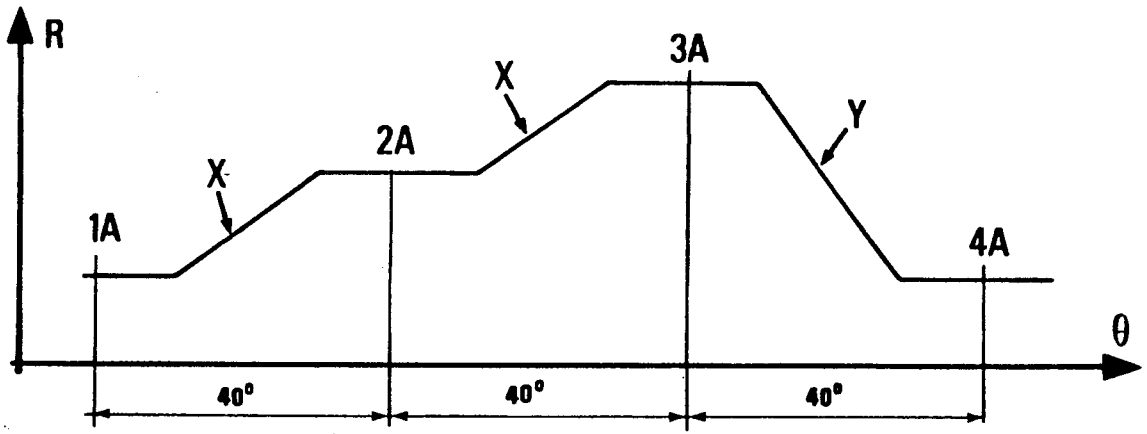
FIG. 12 shows a developed view of a groove bottom profile used in the device of FIG. 11.

FIG. 12 shows the developed curve of the profile of the bottom of groove 92. This profile may correspond, for example, to the case of three blades controlled from the same groove.

The abscissa shows the radius of the bottom of the groove as a function of the angle at the center from an angular reference position. Since three blades are controlled from the same groove and over a revolution, the profile is reproduced identically every 120°. This is why it has been shown only over 120°. When finger 93 of a blade of the stabilizer cooperates with the portion of the groove bottom profile corresponding to the level portion 1A, this blade is in a retracted position. A rotation through 40° of the groove causes a modification of the radius of the groove bottom from the position corresponding to level portion IA to that corresponding to level portion 2A and so to an intermediate extended position in the blade. Another rotation through 40° causes an increase of the groove bottom radius corresponding to level portion 3A and to a maximum extension of the blade. Between each level portion a ramp X permits progressive extension of the blade.

Ramp Y is a downgoing ramp which brings the device back to the retracted position corresponding to level portion 4A having the same value as level portion 1A.

The present invention also relates to a method of using such a fitting particularly by using the means for rotating the whole of the drill-string.

An application of this method is described hereafter, with reference to the fitting shown in FIG. 8.

This fitting is particularly well adapted for drilling a well section comprising: a vertical phase, a beginning of a deflection in a given azimuth of, for example, from 0 to 10 degrees following a precise trajectory, a rising phase at an angle following a given trajectory (radius of curvature) of, for example, 10 to 30 degrees, 40 degrees or even 50 degrees etc . . . , a possible azimuth correction, during or after a third phase, a drilling of a constant angle portion, and a correction of the angle and/or azimuth.

This is made possible by the combination of the angled downhole motor and of the variable diameter stabilizer.

This combination is perfectly used by alternating the drilling periods with rotation of the drilling fitting from the surface with directional drilling periods in which the fitting is held in a given position (tool face). During these two types of period, the radius of curvature of the trajectory of the drilling tool may be modified by varying the geometry (e.g. the diameter) of the stabilizer, in addition to the methods at present available (variation of the weight at the tool, variation of the rotational speed, etc . . . ).

Figure 14:
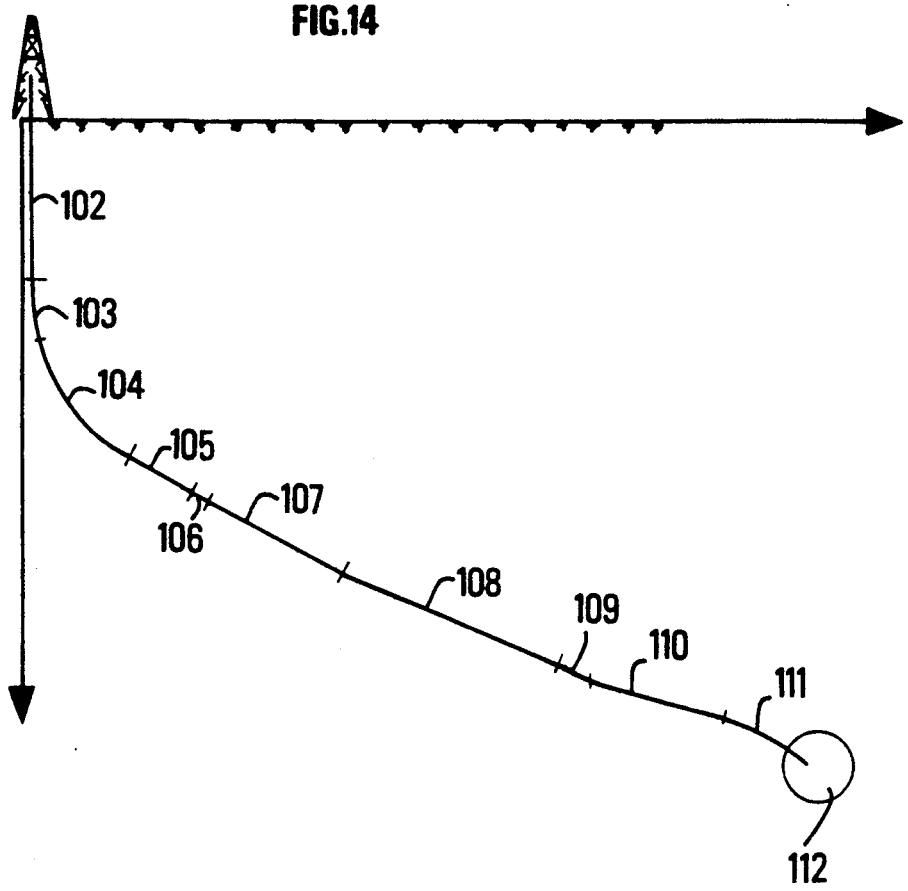
FIGS. 14 and 15 show the trajectory of a drill hole.
Figure 15:
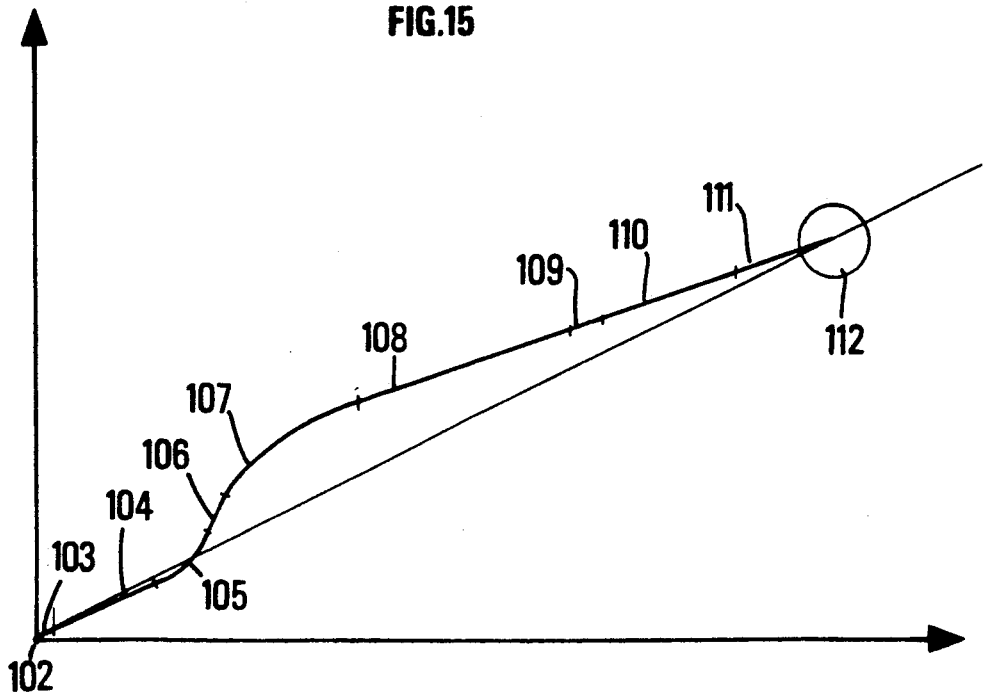

FIG. 14 shows the projection of the trajectory on the vertical plane and FIG. 15 shows the projection of the trajectory on the horizontal plane.

Reference 102 designates the substantially vertical phase of the drilling. This phase is carried out by rotation of the whole of the fitting from the drillstring. In this case, the angle of the elbow element matters little. However, it is preferable for the two articulated portions of this element to be aligned so as to reduce the lateral wear of the components of the fitting. It is obvious that this position of the elbow element is imperative if this phase takes place using only the downhole motor. The diameter of the variable geometry stabilizer 39 is preferably equal to the diameter of the upper fixed geometry stabilizer 41.

Reference 103 designates the beginning of the deflection from 0 to about 10 degrees which is obtained by remote controlling the elbow element so as to obtain a certain angle between the articulated portions of this element, thus causing a lateral force on the tool and by orientation of elbow 37 in the desired azimuth of the drillhole followed by rotation of tool 35 by the downhole motor 36, without the whole of the drilling fitting being driven by the drill-string. The radius of curvature of the well may be adjusted by varying the angle of the elbow element and/or by varying the diameter of the variable geometry stabilizer 39.

Reference 104 designates the rising phase at an angle of about 10 degrees until the desired inclination is reached, without acting on the direction of the well. This phase is obtained by causing the fitting to rotate as a whole from the drill-string. In this case, it is preferable for the articulated parts of the elbow element to be aligned and for the radius of curvature to be adjusted by the diameter of the variable geometry stabilizer 39.

Reference 105 designates a phase for correcting the azimuth which may take place with or without angle correction. In the case of FIGS. 14 and 15, there is no angle correction. This azimuth correction is effected by orienting the elbow element 37 having a non zero angle in the appropriate direction so as to arrive at the desired orientation correction and driving the tool by the downhole motor, without the whole of the fitting being driven by the drill-string.

The choice of the diameter of the variable geometry stabilizer 39 and the value of the angle of the elbow element make it possible to control the radius of curvature of the trajectory.

Reference 106 designates a phase of drilling at a constant inclination without controlling the azimuth. This drilling phase may be achieved by rotating the whole of the drilling fitting from the drill-string.

The phase referenced 107 is an azimuth correction phase of the same type as that described above and which bears the reference 105.

The phases referenced 108 and 110 are drilling phases with constant inclination without azimuth control. They are of the same type as the phase which bears the reference 106.

The phases referenced 109 and 111 are phases for reducing the drift angle.

The above described phases follow each other in time in the order of the reference numbers assigned thereto, going from 102 to 111.

Reference 112 designates the target to be attained by the drilling.

Of course, for other applications, the succession of the different phases and their type may vary depending on the conditions met with during drilling and the objectives to be reached.

Figures 16, 17, 18:
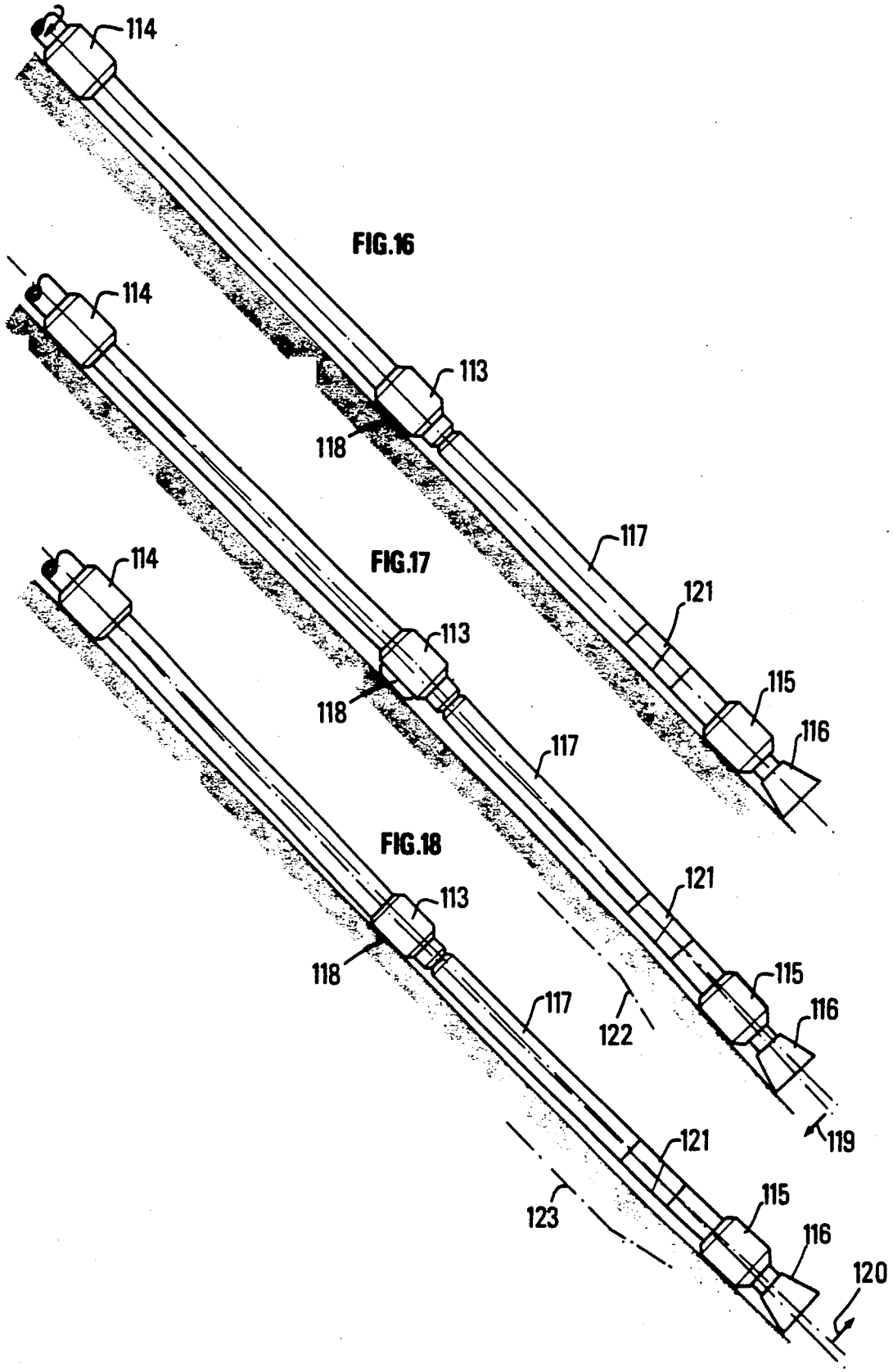
FIGS 16 to 18 show the way in which the trajectory of a drillhole is controlled in the case of using a fitting with three stabilizers, one of which has variable geometry and a variable angle elbow element.

FIGS. 16 to 18 illustrate the control of the direction of the drillhole by means of a fitting comprising three stabilizers, a variable geometry stabilizer 113, two fixed geometry stabilizers situated on each side of the variable geometry stabilizer and a remote controllable variable angle elbow element 121.

The inclination of the drillhole is assumed to be 30 degrees with respect to the vertical. Reference 114 designates the upper fixed geometry stabilizer and reference 115 the lower fixed geometry stabilizer situated near the drilling tool 116. In this example, the fixed stabilizer 115 is fast with the body of the motor 117 as well as the elbow element 121.

The intermediate position of the blades of stabilizer 113 shown in FIG. 16 corresponds to a drillhole with constant inclination angle, the remote controllable elbow element 121 forming a zero angle.

In FIGS. 17 and 18 elbow 121 is assumed to have a deflection angle close to 1 degree.

In FIG. 17, elbow 121 is positioned so as to orient the drillhole downwards of the figure in the direction of arrow 119. This position, shown with a chain dotted line 122, is termed "low side" by the driller.

The angular position of the elbow element 121 is generally checked by conventional measuring means positioned in the drilling fitting. Adjustment of this position is obtained by rotating the drill-string through an appropriate angle from the surface.

In this embodiment, rotation of tool 116 is provided by motor 117.

In FIG. 17, the variable geometry centrer 113 amplifies the reduction of the inclination angle.

FIG. 18 shows an elbow oriented towards the top position generally termed "high side" by the driller, as shown by the chain dotted line 123.

In this method of adjustment, the inclination angle of the drillhole increases.

Control and maintenance of the position of elbow 121 is achieved in the same way as explained above.

In the present application, the inclination angle is considered with respect to the vertical direction.

What is claimed is:

1. A fitting for controlled trajectory drilling comprising a drilling tool placed at an end of said fitting, a motor driving said drilling tool in rotation, at least one stabilizer, and a remote controlled variable angle elbow element disposed below said motor for enabling a selective changing of a trajectory of the drilling, wherein said at least one stabilizer is disposed on either side of said variable angle elbow element so as to facilitate control of a radius of curvature of the trajectory.

2. A fitting for controlled trajectory drilling comprising a drilling tool placed at an end of said fitting, a motor driving said drilling tool in rotation, at least one variable geometry stabilizer, and a remote controlled variable angle elbow for enabling a selective changing of a trajectory of the drilling, wherein said at least one stabilizer is disposed on either side of said variable angle elbow element so as to facilitate control of a radius of curvature of the trajectory.

3. The fitting as claimed in one of claims 1 or 2, further comprising a further stabilizer interlocked for rotation with said drilling tool.

4. The fitting as claimed in one claims 1 or 2, further comprising at least one further stabilizer interlocked for rotation with a body of the motor.

5. The fitting as claimed in one of claims 1 or 2, wherein said elbow element remotely controlled from a surface of a bell accommodating said drilling tool.

6. The fitting as claimed in one of claims 1 or 2, wherein said elbow element is disposed in a vicinity of the drilling tool.

7. The fitting as claimed in claim 7, further comprising a fixed geometry stabilizer disposed in a vicinity of the drilling tool.

8. Use of the fitting as claimed in one of claims 1 or 2, wherein said fitting is disposed at an end of a drill-string rotatably driven by a drive means disposed at a surface of a well accommodating the drilling tool.

9. A fitting according to one of claims 1 or 2, wherein at least two stabilizers are provided on at least one side of said variable angle elbow element.

10. A fitting for controlled trajectory drilling comprising a drilling tool placed at an end of said fitting, a motor driving said drilling tool in rotation, at least one stabilizer, and a remote controlled variable angle elbow element for enabling a selective changing of a trajectory of the drilling, wherein said at least one stabilizer is disposed on either side of said variable angle elbow element so as to facilitate control of a radius of curvature of the trajectory, and wherein said angle elbow element is integrated in said motor.

11. A fitting according to claim 10, wherein said at least one stabilizer is a variable geometry stabilizer.

12. A fitting for controlled trajectory drilling, the fitting comprising a drilling tool disposed at an end of said fitting, a motor means for rotatably driving said tool, at least one stabilizer, a variable angle elbow means disposed below said motor means for selectively controlling an angular position of said drilling tool, and means for remotely controlling a position of said variable angle elbow means, wherein said at least one stabilizer is disposed on either side of said variable angle elbow means so as to facilitate a control of the angular positioning of the drilling tool and trajectory of the drilling.

13. A fitting for controlled trajectory drilling, the fitting comprising a drilling tool disposed at an end of said fitting, a motor means for rotatably driving said tool, a first stabilizer, a variable angle elbow means disposed below said motor means for selectively controlled angular position of said drilling tool, means for remotely controlling a position of said variable angle elbow means, and at least one variable geometry stabilizer means, wherein said first stabilizer is disposed on either side of said variable angle elbow means so as to facilitate a control of the angular positioning of the drilling tool and trajectory of the drilling.

14. A fitting according to claim 10, further comprising a further stabilizer interlocked for rotation with said drilling tool.

15. A fitting according to claim 10, further comprising at least one further stabilizer interlocked for rotation with a body of said motor means.

16. A fitting according to claim 10, wherein said elbow means is remotely controlled from a surface of a well accommodating said drilling tool.

17. A fitting according to claim 15, wherein said elbow means is disposed in a vicinity of the drilling tool means.

18. A fitting according to claim 16, further comprising a fixed geomtry stabilizer disposed in a vicinity of the drilling tool means.

* * * * *